US005348167A

United States Patent [19]

Jensen

[11] Patent Number: 5,348,167

[45] Date of Patent: Sep. 20, 1994

[54] MERCHANDISING HOOK

[76] Inventor: Palle L. Jensen, Backersvej 142, DK-2300 Copenhagen S., Denmark

[21] Appl. No.: 76,241

[22] Filed: Jun. 11, 1993

[51] Int. Cl.[5] ..... A47F 5/00

[52] U.S. Cl. ..... 211/57.1; 211/59.1; 248/220.4; 248/222.2

[58] Field of Search ..... 211/59.1, 57.1, 106; 248/222.2, 220.3, 220.4

[56] References Cited

U.S. PATENT DOCUMENTS

| | | | |
|---|---|---|---|
| 4,351,440 | 9/1982 | Thalenfeld | 211/57.1 |
| 4,512,481 | 4/1985 | Thalenfeld | 211/57.1 |
| 4,674,721 | 6/1987 | Thalenfeld | 248/220.4 |
| 5,080,238 | 1/1992 | Hochman | 211/59.1 |
| 5,231,779 | 8/1993 | Valiulis et al. | 211/59.1 X |

OTHER PUBLICATIONS

P/O/P Times, vol. 6, No. 1, dated Jan./Feb. 1993, pp. 1, 62, and 77.

*Primary Examiner*—Robert W. Gibson, Jr.
*Attorney, Agent, or Firm*—Brooks & Kushman

[57] ABSTRACT

A hook member for a pegboard is disclosed. A U-shaped hook member is rotatably positioned in a channel in a base member, the base member having one or more pin members for attachment to the pegboard. The channels in the base member allow the base member to rotate relative to the pegboard when the U-shaped member is pulled outwardly from the pegboard. After sufficient rotation, the pins are released from the holes in the pegboard.

2 Claims, 2 Drawing Sheets

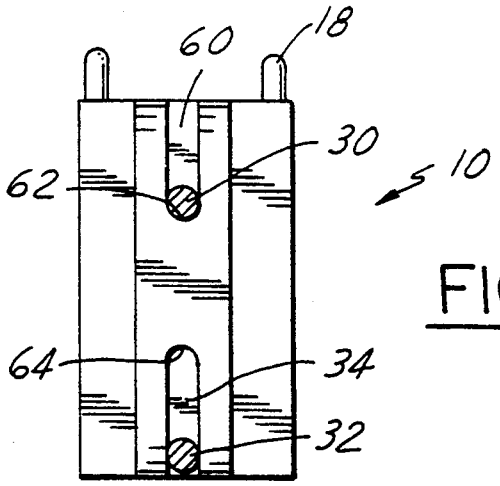
FIG. 4
FIG. 5
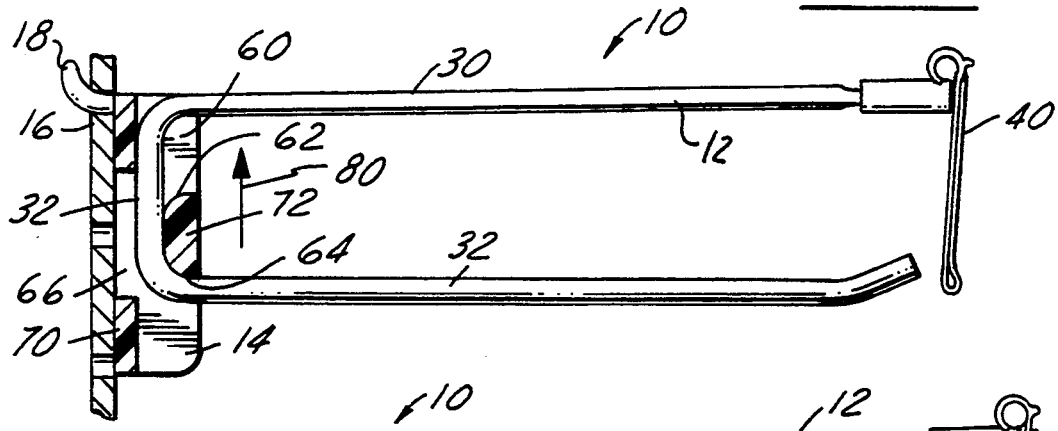
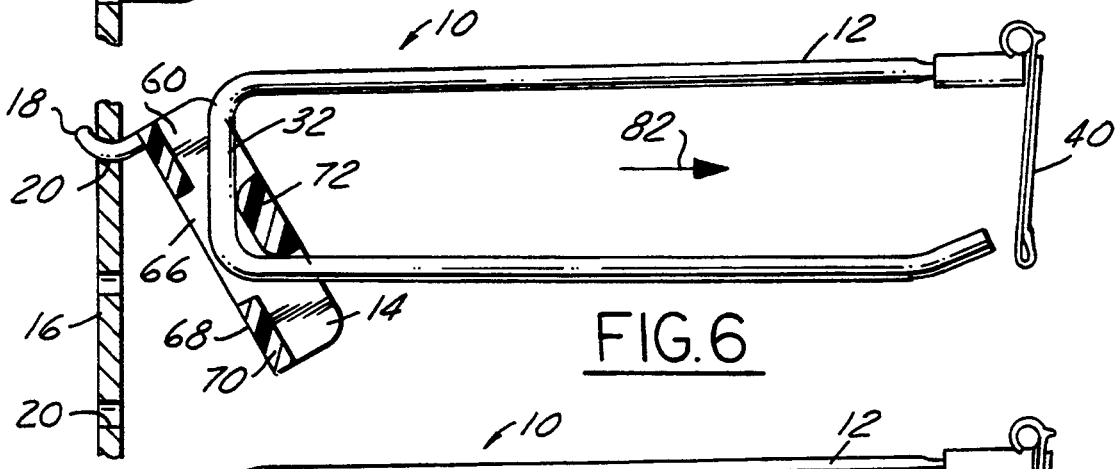
FIG. 6
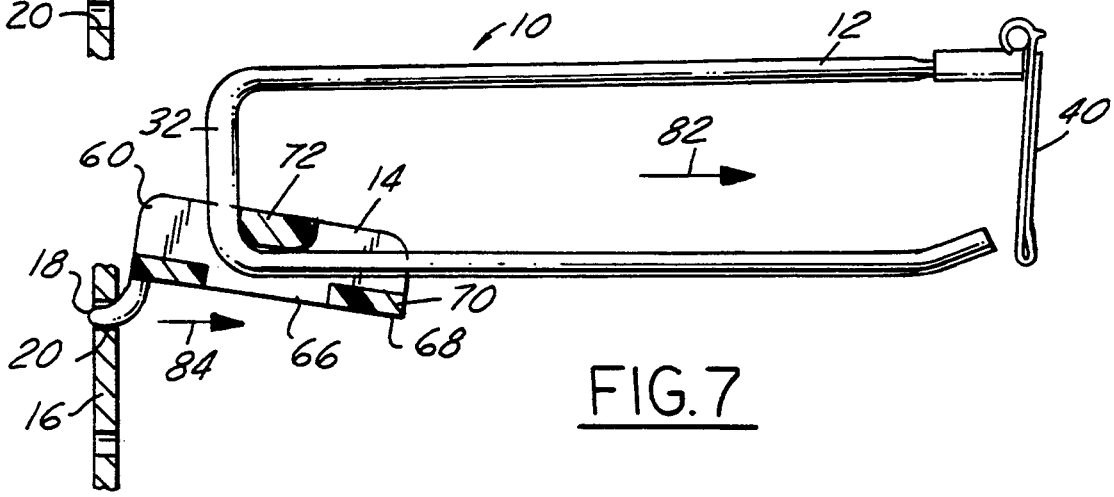
FIG. 7

MERCHANDISING HOOK

TECHNICAL FIELD

This invention relates to an improved hook device for holding and displaying merchandise and other items.

BACKGROUND ART

Businesses today use a wide variety of devices and mechanisms to display their products to consumers and the passing public. For example, products are displayed with hangers, hooks, clips, clamps and the like or presented in bins, pockets, baskets or racks. For versatility and ease of presentation, adjustable hanging, hooking and clipping items are often utilized.

One of the known ways to display and retain products in this manner involves the use of hook members with pegboards. Pegboards comprise planar sheets of material with a plurality of holes or openings spaced uniformly in a grid pattern. The hook members have one, two or more pins or fingers which fit within the holes in order to hold the hook members in place. The merchandise or products are then positioned on the hook member, typically by use of an opening in the product packaging.

The hooks, hangers, clips and the like are made from a wide variety of materials, preferably a hard plastic or metal. For example, metal rods are often used for making the hangers or hook members for pegboards, the member having one or two fingers or pins that are bent at right angles for insertion in holes in the pegboard. The pins are typically welded to the wire rod. The hook members also have one or more elongated members used for mounting the products for presentation.

One of the difficulties with hooks and hangers on pegboards, is that it is difficult to move the hooks or hangers without disrupting or interfering with adjacent products and hangers. The hooks or hangers need to be rotated up to 90° in many instances in order to remove them from the pegboard and this often interferes with products suspended or hanging from adjacent hooks.

It is an object of the present invention to provide an improved merchandise hanger or hook mechanism for use in holding and displaying products. It is another object of the present invention to provide a hook or hanger mechanism for pegboards which overcomes the problems with existing hooks and hangers.

It is a further object of the present invention to provide an improved hanger mechanism for a pegboard in which the hanger mechanism can be removed without interfering with adjacent hangers and products suspended therefrom. It is a still further object of the present invention to provide a hanger for merchandising racks in which the products are not disturbed significantly when the hanger or hook on which they are positioned is removed or moved to a different location.

These and other objects, features and advantages of the present invention will become apparent from the following description, drawings and claims.

DISCLOSURE OF INVENTION

The present invention comprises a U-shaped hook attached to a base member. The base member has one or more channels in which the U-shaped hook is positioned. The base member also has one or more protruding bent fingers or pins which are used to anchor the hook mechanism to a pegboard or the like.

The U-shaped member is movable in the channels in the base member for removal and repositioning. When it is necessary to remove or reposition the device, the U-shaped member is moved longitudinally relative to the base member unlocking the U-shaped member from its horizontally disposed position. The channels in the base member then allow the base member to rotate relative to the pegboard when the U-shaped member is pulled in a direction directly outwardly from the pegboard. When the base member is rotated sufficiently, the bent fingers or pins are released from the holes in the pegboard.

One part of the U-shaped member is used to display a price or product information to consumers. A second part of the U-shaped member is used to hold and display the products.

BRIEF DESCRIPTION OF THE DRAWINGS

FIG. 4 is a view of the merchandising hook shown in FIG. 3 taken and viewed in the direction of the arrows 4—4 in FIG. 3; and FIGS. 5–7 illustrate the removal and repositioning of the present invention on a pegboard.

BEST MODE(S) FOR CARRYING OUT THE INVENTION

Figure 1:
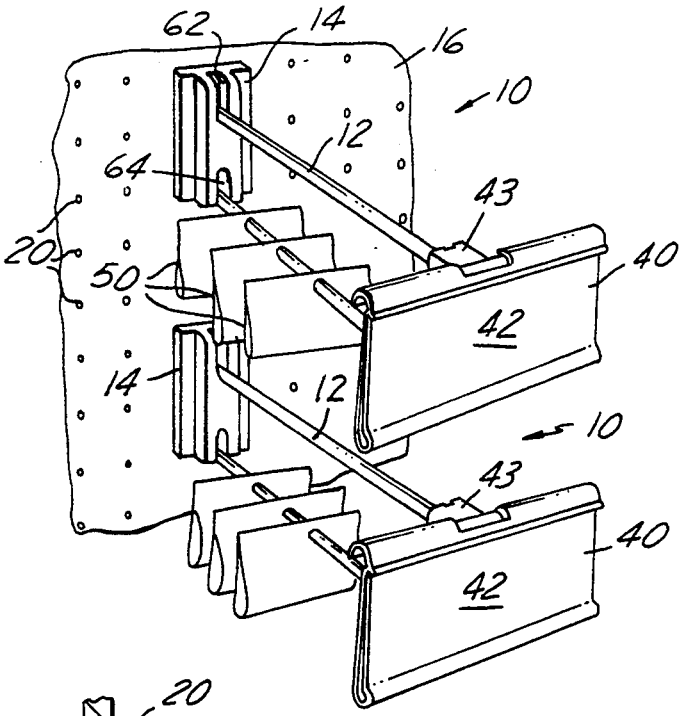
FIG. 1 is a perspective view of a merchandising hook made in accordance with the present invention.

FIGS. 1–4 illustrate the preferred embodiment of the present invention. FIGS. 5–7 depict the manner in which the present invention is positioned and removed from a pegboard and illustrate the benefits and advantages of the present invention.

The present invention relates to a merchandising hook which is referred to generally by the reference numeral 10 in the drawings. The merchandising hook 10 consists of a U-shaped hook member 12 and a base member 14.

The merchandising hooks 10 are adapted to be positioned on a wall or other surface such as pegboard 16 by means of a pair of fingers or pins 18. As shown in the drawings, the pins 18 are bent at approximately 90° angles to fit within holes 20 in pegboard 16.

The U-shaped hook member 12 has an upper leg portion 30 and a lower leg portion 32 connected by a shorter connecting portion 34. The U-shaped hook 12 can be made from a sufficiently sturdy plastic material, but preferably is a piece of bent steel rod formed into the shape shown in the drawings.

Figure 2:
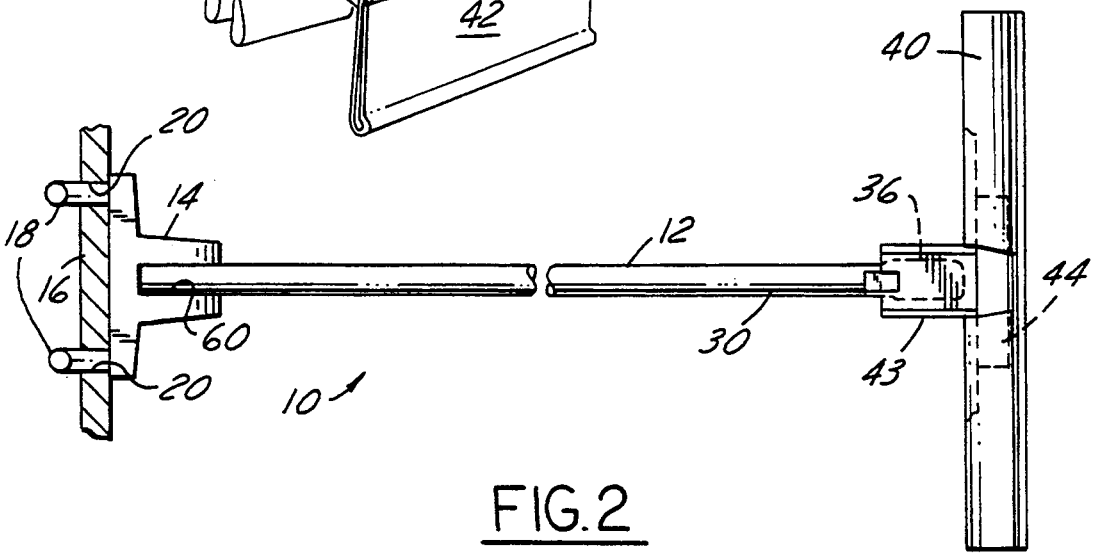
FIG. 2 is a top view of the merchandising hook as shown in FIG. 1.
Figure 3:
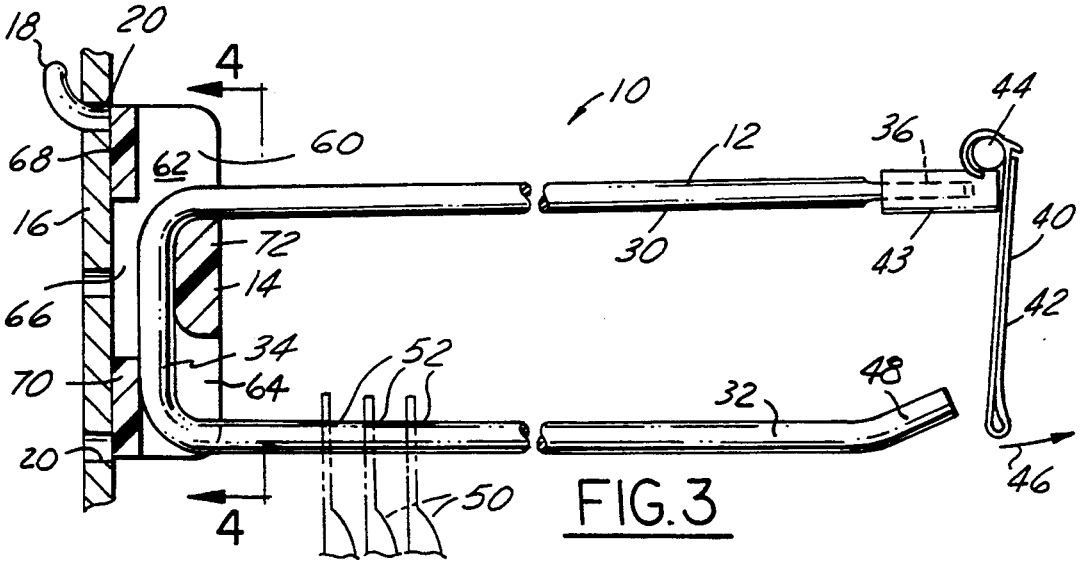
FIG. 3 is a side view of the merchandising hook as shown in FIGS. 1 and 2, showing the base member in cross section.

The upper leg portion 30 of the hook 12 is used to display information concerning the product, such as the price, name, model number, etc. The leg portion 30 extends outwardly perpendicular to the base member and pegboard. The end 36 of the leg portion 30 is flattened as shown in FIGS. 2 and 3 in order to receive a sign member 40. The sign member 40 can be of any conventional type or design, but preferably is of the type shown in the drawings. The sign member 40 has a receptacle or socket 43 in which the flattened end 36 of the leg 30 is securely positioned. The front portion 42 of the sign is pivotally connected to the socket 43 by pivot member 44. The front member 42 of the sign 40 comprises a bent piece of plastic material in which information indicia can be positioned in order to be viewed by consumers. The front portion 42 of the display member 40 also can be moved through means of the pivot 44 in the direction as shown by arrow 46 (FIG. 3) in order to allow merchandise placed on the lower leg portion 32 to be removed or positioned on the leg portion.

Lower leg 32 of the hook 12 extends outwardly parallel to the upper leg 30 and also contains an upwardly curved end 48. Products such as those schematically depicted by the reference numeral 50 in the drawings are hung on the lower leg 32. The products 50 can be mounted on the leg 32 in any conventional manner, such as with the leg portion 32 being positioned through an opening 52 in the packaging of the product 50, or by the use of hangers or clips on the products or packaging.

The base member 14 has a channel 60 in which the hook member 12 is positioned. The channel 60 has an upper channel portion 62 and a lower channel portion 64 which hold the two leg portions 30 and 32, respectively, of the hook member 12. The connecting portion 34 of the hook member 12 is positioned in the channel 60. The channel 60 also has an opening or recess 66 that protrudes or opens through the rear surface 68 of the base member 14.

The base member 14 is preferably made from any sufficiently rigid material, such as polycarbonate or fiber-reinforced nylon. It also could be die cast from a metal material.

When the merchandising hook 10 is installed on the pegboard 16 or other surface, the U-shaped hook member 12 is "locked" in place in the base member 14. This is shown in FIGS. 1–4. In this manner, the upper leg portion 30 is positioned tightly in the bottom of channel portion 62 (FIG. 4) and the lower leg portion 32 is positioned toward the open end of channel portion 64. In this position, the connecting portion 34 is also set or wedged in place between portions 70 and 72 of the base member 14 (see FIG. 3).

When the hook 10 is in the position shown in FIGS. 1–4, the U-shaped hook 12 is held at a position perpendicular to the face of the pegboard 16 and products 50 can be positioned on and removed from the lower leg portion 32.

When it is necessary to remove the merchandising hook 10 from the pegboard 16, whether for repositioning or reuse at a later date, the procedure for accomplishing this is shown in FIGS. 5–7. First, the U-shaped hook member 12 is moved upwardly relative to the base member 14. This is shown by the arrow 80 in FIG. 5. As shown in FIG. 5, this step moves the upper leg portion 30 from the bottom of the channel portion 62 and also moves the lower leg portion 32 into the closed end of channel portion 64.

Secondly, the U-shaped member 12 is pulled out directly away from pegboard 16 in the direction of the arrow 82 in FIGS. 6 and 7. Movement of the U-shaped member 12 in the direction of arrow 82 causes the base member 14 to rotate outwardly away from the pegboard (as shown in FIGS. 6 and 7). The connecting portion 34 of the U-shaped member 12 fits within the open or recessed portion 66 of channel 60 and allows such rotation to take place. Further outward movement of the U-shaped member 12 causes the base member 14 to rotate approximately 90° away from the pegboard 16 and thus allows the pins or finger members 18 to be withdrawn from the openings 20 in the pegboard 16. This movement is shown by the arrow 84 in FIG. 7.

As is evident from the above description of the invention and the drawings, the present invention allows the merchandising hook 10 to be removed and repositioned on a pegboard in a manner which does not disturb or interfere with adjacent hooks and products suspended from adjacent hooks. It is not necessary to rotate the outwardly extending hook member relative to the pegboard. Thus it is possible to easily remove a single hook member 10 from a pegboard 16 without having to remove other adjacent hook member or products from them.

The repositioning or installation of hook 10 on a pegboard can be accomplished in the reverse manner of the removal procedure described above. That is, first the pins 18 are positioned in openings 20 with the base member 14 and U-shaped member 12 oriented in the positions shown in FIG. 7. Then the hook member 12 is pushed in a direction against the pegboard rotating the base member flat against the pegboard. Downward movement of the U-shaped member 12 then locks it in place in the base member (as shown in FIGS. 1–4). Alternatively, if interference with adjacent hooks and products is not a concern, then the hook member 12 can be inserted in a pegboard in a conventional manner (by rotation of the U-shaped member with the base member already locked in place).

Although particular embodiments of the present invention have been illustrated in the accompanying drawings and described in the foregoing detailed description, it is to be understood that the present invention is not to be limited to just the embodiments disclosed, but that they are capable of numerous rearrangements, modifications and substitutions without departing from the scope of the claims hereafter.

It is claimed:

1. A merchandising device for mounting on a display panel, said device comprising:

a continuous wire-like member shaped into a generally U-shaped configuration, said member having a first leg portion, a second leg portion and a third connecting leg portion, said third leg portion having two ends and connecting together said first and second leg portions forming said U-shaped configuration, a base member for supporting said wire-like member on said display panel, said base member comprising at least one pin member for attachment to said display panel, a stop member for holding said wire-like member in its display position on said display panel, and a recess means for allowing rotation of said wire-like member relative to said base member, said stop member having a first surface for supporting said first leg portion and a second surface for supporting said third connecting leg portion, said recess means positioned adjacent said stop member and allowing entry of the end of said third leg portion connected to said second leg portion when said wire-like member is displaced vertically upwards relative to said base member and said base member is then rotated relative to said wire-like member, whereby said wire-like member is held securely in said base member without any components or members affixed thereto.

2. A merchandising hook or the like of the type having a base member and a U-shaped hook member, said hook comprising:

(a) said base member having one or more lug means for releasable connection to a display panel, and (b) said hook member being formed of a wire-like material and having an outwardly extending merchandise support section, a vertically extending back section, and an upper, outwardly projecting display tag section, (c) said back section having two ends, a first end connected to said merchandise support section and a second end connected to said display tag section, (d) said base member having a stop member for supporting a portion of said merchandise support section and said back section without a cross-arm or other member being attached to said hook member, and (e) said base member having a recess means adjacent said stop member in order to allow passage of at least said first end of said back section when said hook member is rotated relative to said base member.

* * * * *